US009068403B2

(12) United States Patent
Berner, Jr. et al.

(10) Patent No.: US 9,068,403 B2
(45) Date of Patent: Jun. 30, 2015

(54) RISER TENSIONER FRAME ASSEMBLY

(71) Applicant: The Technologies Alliance, Inc., Houston, TX (US)

(72) Inventors: Paul C. Berner, Jr., Houston, TX (US); Edward M. Galle, Jr., Kingwood, TX (US)

(73) Assignee: The Technologies Alliance, Inc., Houston, TX (US)

( * ) Notice: Subject to any disclaimer, the term of this patent is extended or adjusted under 35 U.S.C. 154(b) by 0 days.

(21) Appl. No.: 13/968,072

(22) Filed: Aug. 15, 2013

(65) Prior Publication Data

US 2014/0050536 A1 Feb. 20, 2014

Related U.S. Application Data

(60) Provisional application No. 61/683,949, filed on Aug. 16, 2012.

(51) Int. Cl.
*E21B 17/01* (2006.01)
*E21B 19/00* (2006.01)

(52) U.S. Cl.
CPC ..... *E21B 17/01* (2013.01); *E21B 19/002* (2013.01)

(58) Field of Classification Search
CPC ..... E21B 19/002; E21B 19/006; E21B 17/02; F16L 27/103
USPC ..... 405/224.4; 285/263; 166/355
See application file for complete search history.

(56) References Cited

U.S. PATENT DOCUMENTS

| | | | | |
|---|---|---|---|---|
| 4,272,059 | A | 6/1981 | Noerager et al. | |
| 5,950,737 | A | 9/1999 | Chou et al. | |
| 6,260,625 | B1 | 7/2001 | Phan et al. | |
| 7,329,070 | B1 | 2/2008 | Trent et al. | |
| 8,021,081 | B2 | 9/2011 | Crotwell et al. | |
| 2005/0147473 | A1 * | 7/2005 | Pallini et al. | 405/224.4 |
| 2008/0031692 | A1 | 2/2008 | Wybro et al. | |
| 2008/0205992 | A1 | 8/2008 | Ellis et al. | |
| 2009/0145611 | A1 * | 6/2009 | Pallini et al. | 166/355 |
| 2010/0147528 | A1 | 6/2010 | Baugh | |
| 2010/0158615 | A1 * | 6/2010 | Ellis et al. | 405/224.4 |
| 2011/0170955 | A1 * | 7/2011 | Koos et al. | 405/224.4 |
| 2012/0207550 | A1 * | 8/2012 | Aksel et al. | 405/224.4 |
| 2012/0247783 | A1 | 10/2012 | Berner, Jr. et al. | |

* cited by examiner

*Primary Examiner* — Tara M. Pinnock
(74) *Attorney, Agent, or Firm* — Bracewell & Giuliani LLP

(57) ABSTRACT

A riser tensioner for maintaining a tensile force on a riser extending through an opening in a deck of a floating platform includes a frame assembly that may be quickly bolted together in the field. The frame assembly includes a plurality of tensioner legs that may be installed on an un-level deck yet still provide a level support of the riser. Lower leg mounting assemblies include a slip ring for mounting directly to the deck and a deck mounting member received in the slip ring at a variable angle and having an upwardly extending shaft passing into a bore in a lower end of a tensioner leg.

18 Claims, 7 Drawing Sheets

FIG. 3
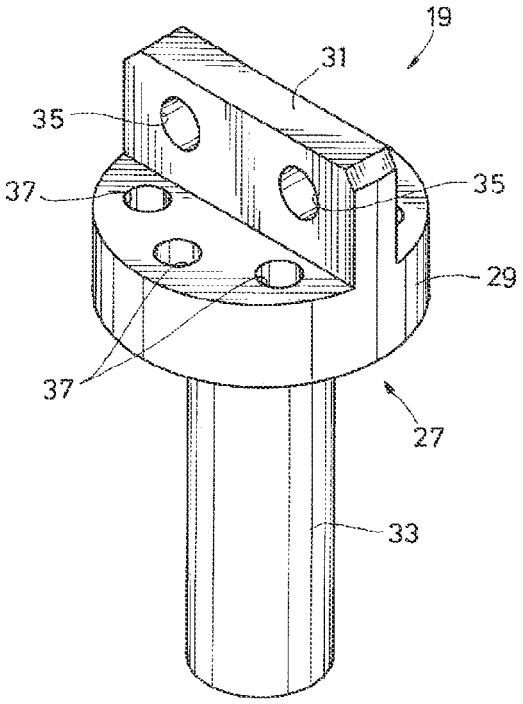
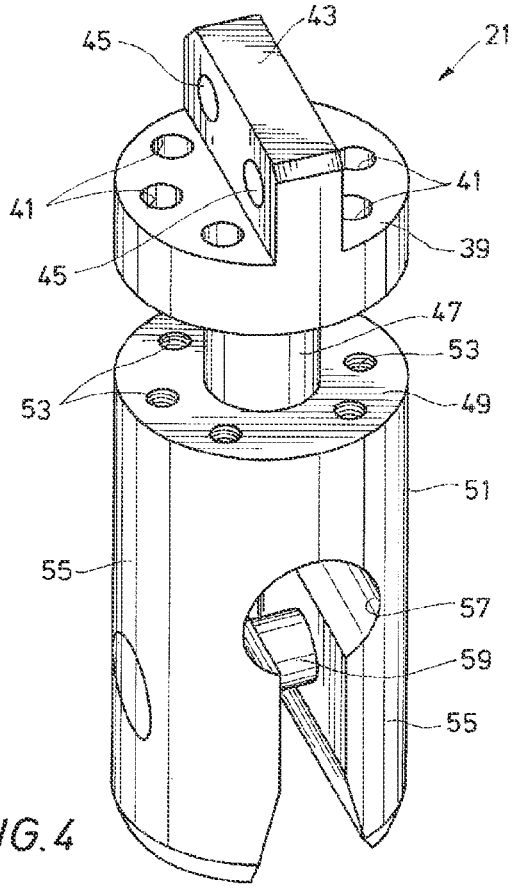
FIG. 4

FIG. 6
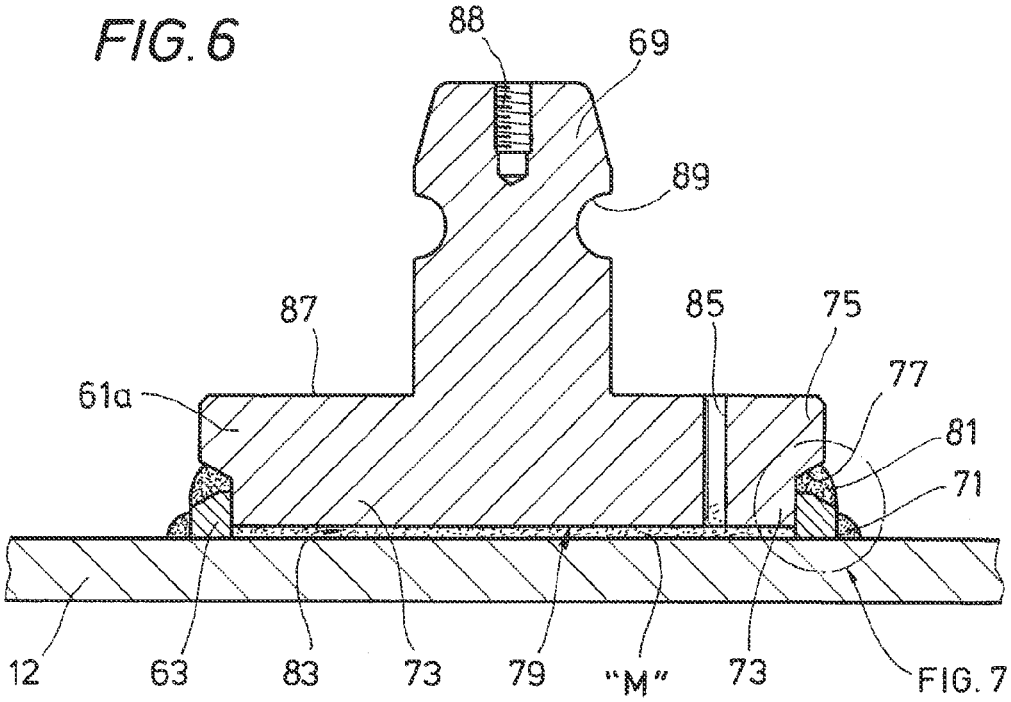
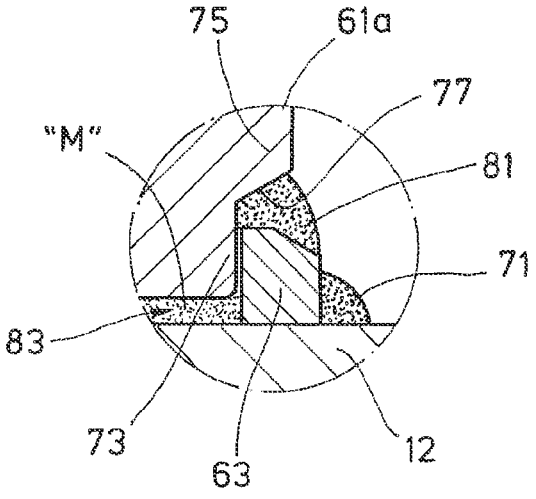
FIG. 7

RISER TENSIONER FRAME ASSEMBLY

RELATED APPLICATION

This application is a non-provisional of and claims the benefit of and priority to U.S. Provisional Patent Application No. 61/683,949 titled "Riser Tensioner Frame Assembly" filed Aug. 16, 2012, which is incorporated herein by reference in its entirety.

BACKGROUND

1. Field of Invention

The present invention relates generally offshore drilling and production systems, which are employed, e.g., for drilling and producing subsea oil or gas wells. In particular, the invention relates to marine riser tensioners for maintaining a tensile force on a riser extending from a subsea wellhead assembly through an opening in a deck of a floating platform.

2. Description of Related Art

Offshore production platforms must support production risers from oil or gas wells that extend to the platform from subsea wells. This is accomplished through the use of riser tensioners or riser tensioning mechanisms that hold the riser in tension between the production platform and the wellhead. The riser tensioning mechanism maintains the riser in tension so that the entire weight of the riser is not transferred to the wellhead and to prevent the riser from collapsing under its own weight. The tensioning mechanism must therefore exert a continuous tensional force on the riser that is maintained within a narrow tolerance. Often, the production platform is a floating structure that moves laterally, vertically, and rotationally with respect to the fixed equipment at the seafloor. Thus, the riser tensioner mechanism must simultaneously provide support to a riser while accommodating the motion of the surface facility or platform.

Risers extend through a platform in a well slot, an opening in a deck of the platform for passage of the riser string. At a defined elevation within a platform's well slot, a riser's lateral motion is restricted by a guidance device that reacts laterally against a riser, preventing lateral displacement of the riser while still permitting vertical movement of riser in order to keep an upper termination of the riser within the boundaries Of the well slot. The portion of a riser's upper termination above and below the guidance device can still move laterally as the riser rotates about the location of the lateral guidance device. The magnitude of the lateral motion of the upper termination of the riser is directly proportional to its elevation above or below the guidance device. It is desirable to have the guidance device located proximate to equipment coupled to the upper termination of the riser to decrease movement of the portion above the guidance device. As a result, it may be desirable to place the guidance device on an upper portion of a riser tensioner frame of the riser tensioner system rather than on a lower platform deck where the tensioner system is mounted. This may create problems as the riser tensioner frame must be sufficiently strong to react to the lateral loading by the riser.

Riser tensioner system frames may comprise a multitude of components. In sonic prior art embodiments, the tensioner frame includes a tensioner frame ring formed of a multitude of straight elements welded together at angled joints. Legs extend from the deck into the well slot to mount to the tensioner frame ring. The legs will join the tensioner frame ring at coped joints. Generally, each component is welded together and, due to the angled and coped joints, this makes for difficult fabrication. In addition, the angles at each joint transfer the loading of the tensioner frame from the structural elements to the welds joining each element. Thus, the strength of the tensioner is placed on welds that may be located in positions and angles that are difficult to form. Improper welding may lead to a frame with a significantly reduced strength that is prone to early failure.

SUMMARY OF EMBODIMENTS OF THE INVENTION

A riser tensioner is described for maintaining a tensile force on a riser that extends through an opening in a deck of a floating platform from a subsea wellhead assembly. The riser tensioner includes a frame assembly that may be quickly bolted together in the field. Methods and devices are described that allow for a plurality of tensioner legs of the frame assembly to be properly positioned and installed on an un-level deck, yet still provide a level support of the riser.

In accordance with an embodiment of the present disclosure, a tensioner frame assembly for transferring loads from a riser extending from a subsea wellhead assembly through an opening in a deck of a floating platform to the deck of the floating platform includes a support ring and a plurality of cylinder mounting assemblies coupled to the support ring, which are operable to couple a riser tensioner to the support ring. A plurality of tensioner legs each have an upper end coupled to the support ring and a lower end for mounting to the deck. The lower end of each tensioner leg of the plurality of tensioner legs have a bore disposed therein. A plurality of lower leg mounting assemblies are adapted to be mounted directly to the deck and include an upwardly extending shaft passing through the bore disposed in the lower end of a respective tensioner leg.

In accordance with another embodiment of the present disclosure, a method of securing a tensioner frame assembly to a deck of a floating platform having an opening for a riser includes the steps of: (a) providing a jig including a plurality of radially spaced receptacle assemblies; (b) securing a respective deck mounting member to each receptacle assembly of the plurality of receptacle assemblies; (c) aligning the jig with the opening such that each receptacle assembly of the plurality of radially spaced receptacle assemblies is radially spaced about the opening and each deck mounting member is vertically approximated with the deck; (d) positioning a plurality of slip rings on the deck such that each respective slip ring of the plurality of slip rings is located beneath a respective deck mounting member; (e) lowering the jig to land each deck mounting member into the respective slip ring to thereby locate the respective slip rings in aligned positions on the deck; (f) securing the respective slip rings to the deck in the aligned positions; (g) securing the respective deck mounting members to the respective slip rings; (h) decoupling the respective deck mounting members from each of the respective receptacle assemblies; and (i) fastening a respective tensioner leg of the tensioner frame assembly to each of the deck mounting members.

In accordance with another embodiment of the present disclosure, a riser tensioner for maintaining a tensile force on a riser extending from a subsea wellhead assembly through an opening in a deck of a floating platform includes a plurality of tensioner legs each having a lower end for mounting to the deck. An annular support ring is positioned proximate upper ends of the tensioner legs, and a plurality of leg mounting assemblies is provided each having a shaft adapted to pass through a corresponding bore in the support ring and into a bore in an upper end of the tensioner legs. A plurality of lower leg mounting assemblies are adapted to be mounted to the deck and have an upwardly extending shaft adapted to pass through a bore in a lower end of a respective tensioner leg. A plurality of cylinder mounting assemblies is adapted to mount to the support ring at one of the plurality of bores formed therein.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification, it is to be noted, however, that the drawings illustrate only preferred embodiments of the invention and are therefore not to be considered limiting of its scope as the invention may admit to other equally effective embodiments.

FIG. 3 is a perspective view of a portion of a leg mounting assembly of the riser tensioner frame assembly of FIG. 1 in accordance with an embodiment.

FIG. 4 is a perspective view of a cylinder mounting assembly of the riser tensioner frame assembly of FIG. 1 in accordance with an embodiment.

FIG. 6 is a sectional view of a deck mounting member of the lower portion of the leg of the riser tensioner frame assembly of FIG. 5 in accordance with an embodiment.

FIG. 7 is a detail view of a coupling between the deck mounting member and a slip ring of the lower portion of the leg of the riser tensioner frame assembly of FIG. 6 in accordance with an embodiment.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning well drilling, running operations, and the like have been omitted inasmuch as such details are not considered necessary to obtain a complete understanding of the present invention, and are considered to be within the skills of persons skilled in the relevant art.

Figure 1:
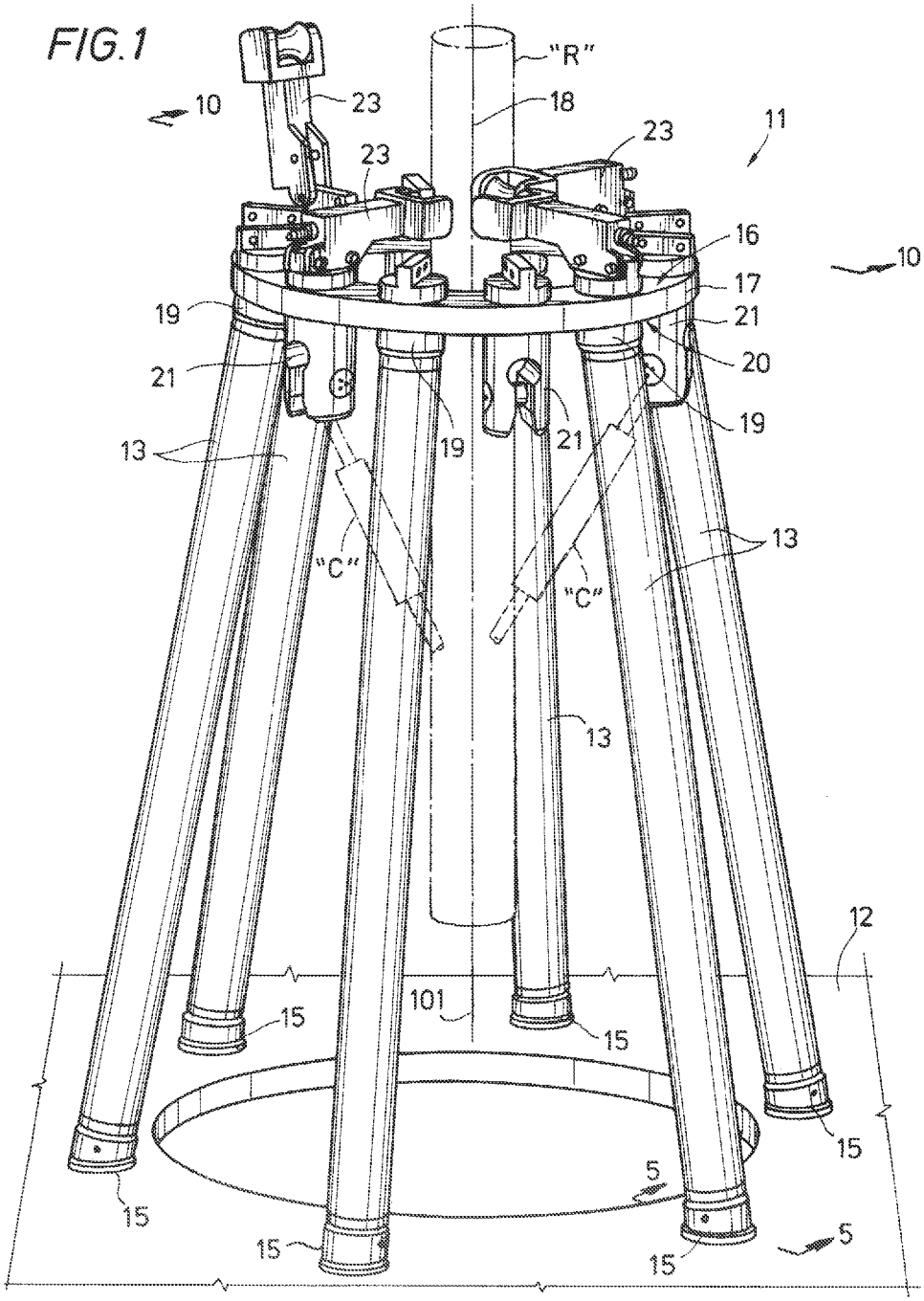
FIG. 1 is a perspective view of a riser tensioner frame assembly in accordance with an embodiment.

Referring to FIG. 1, there is shown a riser tensioner frame assembly 11. Riser tensioner frame assembly 11 may be a pull up tensioner adapted to receive one or more hydraulic cylinders "C" (shown schematically) coupled to a subsea riser "R" (shown schematically) and hold the riser in tension between a deck 12 to which riser tensioner frame assembly 11 is mounted and a subsea wellhead (not shown) as is known in the art. A person skilled in the art will recognize that deck 12 may be a portion of a drilling or production platform disposed on a body of water for oil and gas drilling and production activities. Riser tensioner frame assembly 11 includes a plurality of riser tensioner legs or legs 13. In the illustrated embodiment, riser tensioner frame assembly 11 includes six legs 13; a person skilled in the art will understand that more or fewer riser tensioner legs 13 may be used as needed for the particular application of riser tensioner frame assembly 11. Each leg 13 mounts to deck 12 with a lower leg mounting assembly 15. Each leg 13 extends between deck 12 and a support ring 17 disposed spaced apart from deck 12 and, in the illustrated embodiment, axially above deck 12 along an axis 18 of support ring 17. Each leg 13 mounts to support ring 17 with an upper leg mounting assembly 19. A plurality of cylinder mounting assemblies 21 mount to support ring 17 and are adapted to further mount to hydraulic cylinders "C" adapted to pull up on the riser "R" disposed in a medial portion of support ring 17. A plurality of riser centralizers 23 mount to at least one of the plurality of upper leg mounting assemblies 19 and cylinder mounting assemblies 21.

Figure 2:
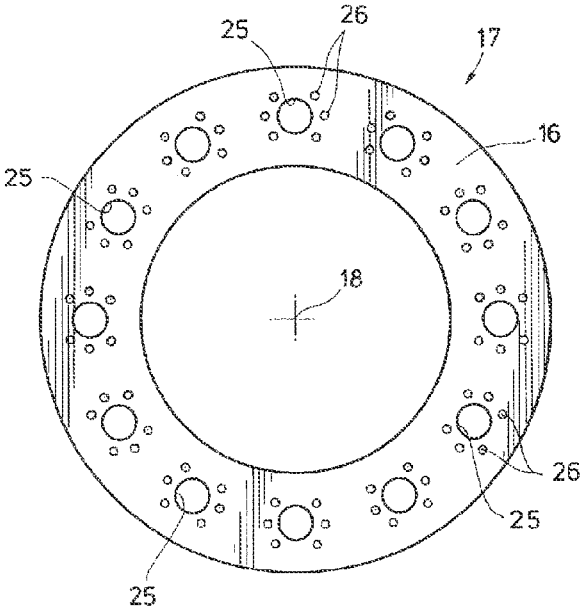
FIG. 2 is a top view of a planar support ring of the riser tensioner frame assembly of FIG. 1 in accordance with an embodiment.

Referring to FIG. 2, support ring 17 is a generally disc like object having an inner diameter sufficiently large enough to allow for passage of the riser "R" through the inner diameter of support ring 17. Support ring 17 has a thickness from the inner diameter of support ring 17 to an outer diameter of support ring 17 to provide generally planar upper and lower surfaces 16, 20 with sufficient surface area for transfer of load from cylinder mounting assemblies 21 to support ring 17, and from support ring 17 to upper leg mounting assemblies 19 as described in more detail below. In the illustrated embodiment, an annular thickness, e.g., a thickness from the inner diameter to the outer diameter of support ring 17, is equal to or greater than the diameter of leg 13. This allows the entire of an upper portion of each leg to abut lower surface 20 of support ring 17 as described in more detail below. A distance from upper surface 16 of support ring 17 to lower surface 20 of support ring 17 is of sufficient thickness to resist shear loading of support ring 17 parallel to axis 18 of support ring 17 provided by loads exerted by leg mounting assemblies 19 and cylinder mounting assemblies 21. Support ring 17 is a substantially planar or generally flat member having a plurality of bores 25 formed therein. In the illustrated embodiment, there are twelve bores 25 circumferentially spaced around support ring 17. A person skilled in the art will understand that more or fewer bores 25 may be formed in support ring 17 depending on the particular riser tensioner assembly 11. Bores 25 extend through support ring 17 from upper and lower planar surfaces 16, 20 so that an object may be passed through support ring 17 at each bore 25. A plurality of smaller bores 26 is arranged circumferentially around each bore 25. The smaller bores 26 also pass completely through support ring 17 so that fasteners may be passed through the bores and secured on either side of support ring 17.

As shown in FIG. 3, upper leg mounting assembly 19 includes a mounting pin 27. Mounting pin 27 includes a planar disc 29 having an outer diameter larger than the diameter of bores 25. An upwardly extending member 31 joins planar disc 29 near a medial portion of planar disc 29. In the embodiment illustrated, member 31 has a length equivalent to a diameter of planar disc 29, but embodiments are contemplated where the length of member 31 is less than a diameter of disc 29. Member 31, includes two bores 35 adapted to receive fasteners for mounting of riser centralizers 23 (FIG. 1) thereto. Mounting pin 27 includes a leg penetrating shaft 33 depending from planar disc 29 from a medial portion of planar disc 29 opposite member 31. Shaft 33 has a diameter approximating the diameter of bores 25 (FIG. 2) to closely fit therein so that shaft 33 may be inserted into bore 25 and pass through support ring 17. A plurality of mounting bores 37 are formed in planar member 29 and circumferentially spaced thereon. Mounting bores 37 are adapted to receive fasteners to mount mounting pin 27 to support ring 17 and an upper portion of leg 13. In an embodiment, bores 37 correspondingly align with the smaller bores 26 surrounding bores 25 of support ring 17.

Cylinder mounting assembly 21 is illustrated in FIG. 4. Cylinder mounting assembly 21 includes a cylinder mounting plate 39, having a plurality of cylinder mounting bores 41 formed therein and circumferentially spaced thereon. Cylinder mounting bores 41 are adapted to receive fasteners to secure cylinder mounting assembly 21 to support ring 17 (FIG. 1). Cylinder mounting plate 39 may be a circular disc like object having an outer diameter larger than the diameter of bores 25. In the illustrated embodiment, cylinder mounting plate 39 has an outer diameter equivalent to the outer diameter of planar disc 29 of mounting pin 27 (FIG. 3). An upwardly extending member 43 joins cylinder mounting plate 39 near a medial portion of cylinder mounting plate 39. Member 43 has a length equivalent to a diameter of cylinder mounting plate 39. Member 43 includes two bores 45 adapted to receive fasteners for mounting of riser centralizers 23 (FIG. 1). Cylinder mounting assembly 21 includes a shaft 47 depending from a medial portion of cylinder mounting plate 39 opposite member 43. Shaft 47 has a diameter approximating the diameter of bores 25 (FIG. 2) so that shaft 47 may be inserted into bore 25 and pass through support ring 17. Shaft 47 may extend through support ring 17 into a base member 49 of a clevis 51. Base member 49 is a circular member having a planar upper surface with a plurality of bores 53 formed therein and circumferentially spaced thereon. Fasteners may pass through bores 41, the smaller bores 26 surrounding each bore 25 of support ring 17 and thread into bores 53 to secure clevis 51 to support ring 17 and cylinder mounting plate 39. Clevis 51 is a generally cylindrical member having two legs 55 depending downward from base member 49. Clevis 51 has a key hole 57 extending thereihrough between legs 55 to receive a coupler of a hydraulic cylinder "C" (FIG. 1). Legs 55 include bores extending therethrough to allow passage of a pin 59 to secure to the coupler of the hydraulic cylinder "C", thereby securing the hydraulic cylinder "C" to the clevis 51 and support ring 17.

Figure 5:
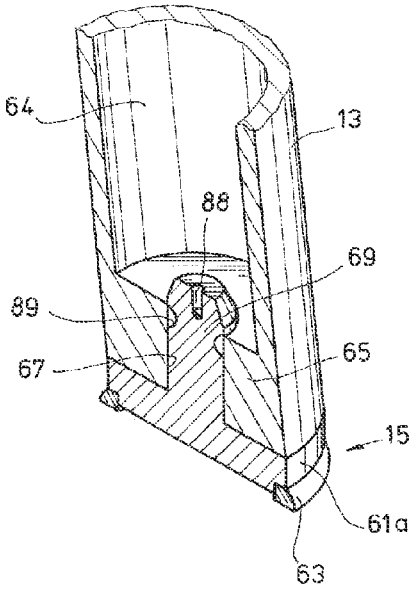
FIG. 5 is a sectional view of a lower portion of a leg of the riser tensioner frame assembly of FIG. 1 taken along line 5-5 in accordance with an embodiment.

Lower leg mounting assembly 15 is illustrated in FIG. 5. Lower leg mounting assembly 15 includes a deck mounting member 61*a* and a slip ring 63. Slip ring 63 may mount to deck 12 (FIG. 1), and deck mounting member 61*a* may mount to slip ring 63 as described in more detail below. A lower portion of leg 13 includes a hollow interior 64 and a solid portion 65 at a lower end thereof. The solid portion 65 has a bore 67 formed therein extending to the hollow interior 64. Deck mounting member 61*a* includes an upwardly extending shaft 69 proximate to a medial portion of deck mounting member 61*a*. As shown in FIG. 5, shaft 69 may insert into bore 67, positioning leg 13 so that an outer circumferential surface of leg 13 is aligned with an outer circumferential surface of deck mounting member 61*a*. In the illustrated embodiment, leg 13 may be flush with deck mounting member 61*a* so that leg 13 may be secured to deck mounting member 61*a*, for example, by welding. In other embodiments, leg 13 may be secured to deck mounting member 61*a*, for example, by use of fasteners or pins.

Referring to FIGS. 6 and 7, slip ring 63 may be positioned on deck 12 at a desired location in a manner described in more detail below. Slip ring 63 may be mounted directly to deck 12, and in the illustrated embodiment, may be welded to deck 12 with weld 71. Deck mounting member 61*a* includes a lower end 73 adapted to fit within the inner diameter of slip ring 63. Deck mounting member 61*a* also includes a mounting flange 75 extending from an upper surface 87 of deck mounting member 61*a* to lower end 73. Mounting flange 75 has a diameter that is larger than the diameter of end portion 73 so that a generally downward facing shoulder 77 is formed on mounting flange 75. When lower end 73 of deck mounting member 61*a* is inserted into slip ring 63, a lower surface 79 of lower end 73 may be spaced an upper surface of deck 12 as illustrated. In some other embodiments, lower surface 79 may be in contact with deck 12 or have a portion that contacts deck 12. For example, deck mounting member 61*b* (described below with reference to FIG. 9) includes a circumferential ring 124 that may contact deck 12. Deck mounting member 61*b* is identical to deck mounting member 61*a* other than circumferential ring 124. A person skilled in the art will recognize that there may be a gap between vertical surfaces of slip ring 63 and vertical surfaces of lower end 73 of deck mounting member 61*a*. In some embodiments, the vertical surfaces of slip ring 63 and lower end 73 may not be parallel depending on the horizontal position of deck 12. In addition, downward facing shoulder 77 may be proximate to an upper surface of slip ring 63. Deck mounting member 61*a* may then be secured to slip ring 63 in any suitable manner. In the illustrated embodiment, deck mounting member 61*a* is welded to slip ring 63 at downward facing shoulder 77 and the upper surface of slip ring 63 with weld 81. As shown in FIG. 6, a cavity 83 may be formed between the upper surface of deck 12 (or a lower surface of slip ring 63), an inner diameter surface of slip ring 63, and lower surface 79 of deck mounting member 61*a*. Deck mounting member 61*a* also includes a passage 85 extending from upper surface 87 of deck mounting member 61*a* into cavity 83. A person skilled in the art will recognize that deck mounting member 61*a* may include more than one passage 85. During installation of deck mounting member 61*a*, use of slip ring 63 allows for accommodation of un-level mounting of leg 13 to deck 12, for example if deck 12 is not level or angled at the particular mounting location, or if the elevation of the deck changes from ring to ring so that one leg 13 is positioned on a portion of deck 12 that may be not be at the exact elevation of the mounting locations of other legs 13. Slip ring 63 mounts directly to deck 12, deck mounting member 61*a* may be positioned so that lower surface 79 is at an angle to deck 12 causing cavity 83 to be larger or smaller proximate to one portion of slip ring 63. Weld 81 may then fill the varying gap between slip ring 63 and deck mounting member 61*a* around the annular weld area.

In an exemplary embodiment, welds 71, 77 may be formed in accordance with weld procedure specification qualified to AWS D1.1 and approved by a qualified welding engineer with current AWS, CWI, or CAWI certification. The welder procedure qualification records (PQR) may be qualified to AWS D1.1, and reviewed by a qualified welding engineer with AWS, CWI, or CAWI certification. Welding procedure may be in accordance with AWE Section IX and/or API 1104 and approved by a qualified welding engineer with current AWS, CWI, or CAWI certification. Welds 71, 77 may be contoured by grinding, although in the disclosed embodiments, no grinding of deck mounting member 61*a* or slip ring 63 occurs. In an embodiment, following completion of welds 71, 77, welds 71, 77 may be inspected utilizing magnetic particle inspection (MPI) methods. A person skilled in the art will recognize that welds 71, 77 may be formed to other specifications and standards depending on the particular application of frame assembly 11.

Once deck mounting member 63 is welded to slip ring 61*a*, a casting compound "M" may be supplied to cavity 83 through passage 85. The casting compound "M" may fill cavity 83 and set to form a solid member for load transfer between deck mounting member 61*a* and deck 12. In an embodiment, the casting compound "M" may be Chockfast® Orange. Chockfast® Orange (PR-610TCF) is a specially formulated 100% solids, two component inert filled casting compound developed for use as a chocking or grouting material. Chockfast® is designed to withstand more severe marine and industrial environments involving a high degree of both. physical and thermal shock. The compound is non-shrinking and has very high impact and compressive strength. Chockfast® Orange may be used under marine machinery in depths of ½" to 4". A person skilled in the art will understand that other filling or casting compounds compound "M" may be used provided they may be passed through passage 85 into cavity 83 to harden and provide for load transfer between deck mounting member 61*a* and deck 12.

As shown in FIG. 6, shaft 69 of deck mounting member 61*a* includes a threaded bore 88 extending from an outer peripheral end of shaft 69 toward deck mounting member 61*a*. In addition, an annular groove 89 is formed in shaft 69 proximate to the peripheral end of shaft 69. Groove 89 may be adapted to receive a pin passed through leg 13 and partially into groove 89 to secure leg 13 to deck mounting member 61*a* at shaft 69.

Figure 8A:
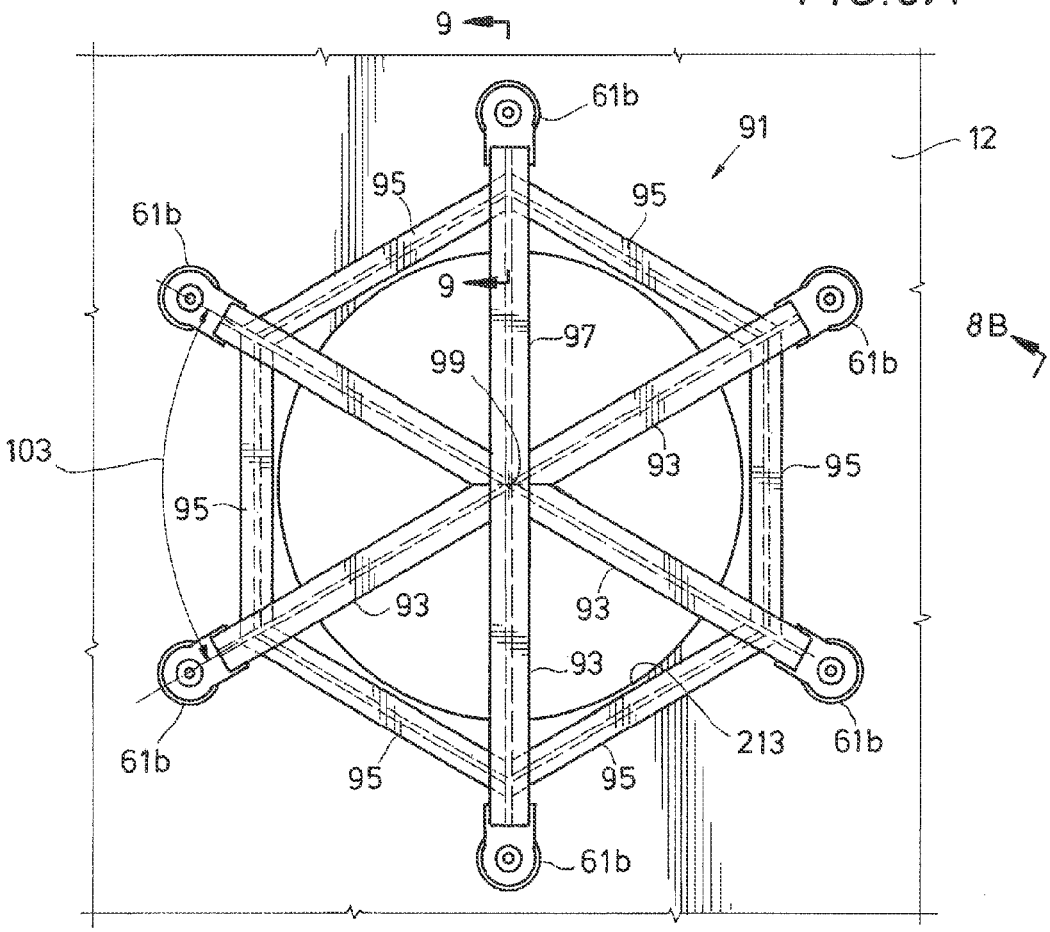
FIG. 8A is a top view of an alignment jig adapted to locate the deck mounting members of FIG. 5 on a deck of a subsea platform in accordance with an embodiment.

Referring to FIG. 8A, a placement jig 91 may be used to position slip rings 63 and deck mounting members 61*b* at the appropriate locations on deck 12 to align with legs 13. Jig 91 includes placement members 93 and spacing members 95. In the illustrated embodiment, a main alignment member 97 is adapted to extend between two deck mounting members 61*b* of two separate legs 13 (FIG. 1) positioned on opposite sides of tensioner frame assembly 11. Main alignment member 97 will pass through an axis 99 of jig 91. Axis 99 may be aligned with an axis 101 (FIG. 1) of tensioner frame assembly 11 so that ends of main alignment member 97 extend from a location proximate to a first leg 13 to a location proximate to a second leg 13 on an opposite side of tensioner frame assembly 11. In the illustrated embodiment of FIG. 8A, two placement members 93 may extend from either side of main alignment member 97. As shown, each placement member 93 extends from axis 99 to a location proximate to a separate leg 13 (FIG. 1). A person skilled in the art will understand that alternative embodiments of jig 91 will include more or fewer placement members 93, provided that there is a placement member 93 for each leg 13 not placed by main alignment member 97. Thus, a riser tensioner assembly 11 having more or fewer legs 13 may be placed with a jig 91 having more or fewer placement members 93. A separate spacing member 95 extends between each placement member 93 and between main alignment beam 97 and adjacent placement members 93. Spacing members 95 maintain the positioning between adjacent placement members 93 and between placement members 93 and main alignment member 97 so that an angle 103 is maintained between each member. In the illustrated embodiment, angle 103 is approximately 60 degrees. A person skilled in the art will understand that the angle between each member 93, 97 may vary depending on the number of members 93, 97 needed to place deck mounting members 61*b* at appropriate locations under each leg 13.

Figure 8B:
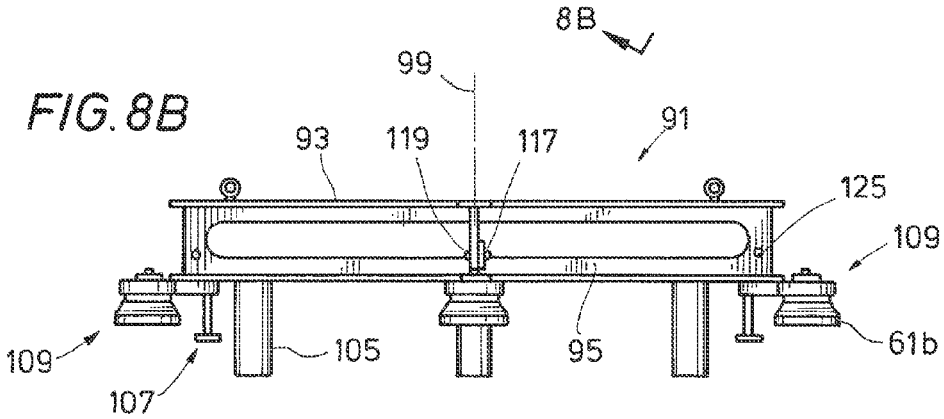
FIG. 8B is a side view of the example of the alignment jig of FIG. 8A in accordance with an embodiment.
Figure 9:
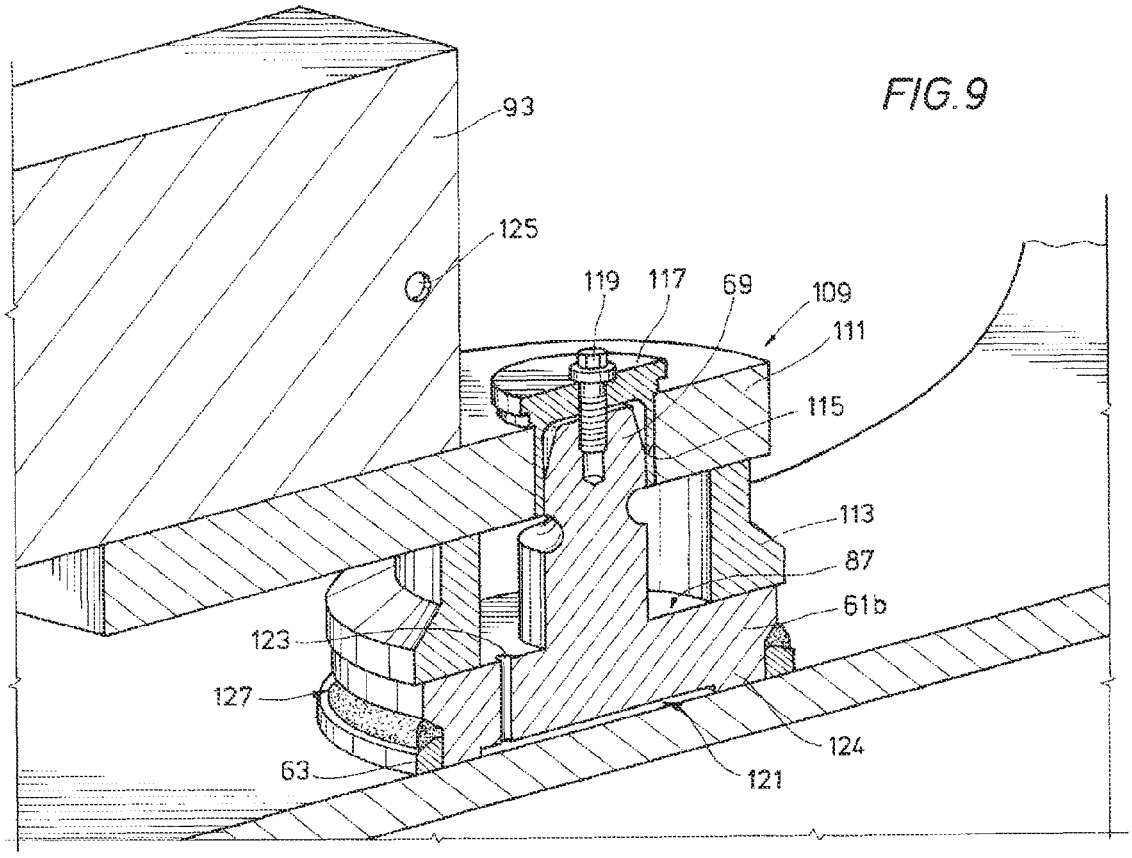
FIG. 9 is a side sectional view of the alignment jig of FIG. 8A taken along line 9-9 of FIG. 8A in accordance with an embodiment.

FIG. 8B is a side view of the example jig 91 of FIG. 8A taken along lines 8B-8B. Included with this example of the jig 91 are annular tube supports 105 that project generally perpendicularly away from a lower surface of placement members 93. In an example, the tube supports 105 are disposed on alternating placement members 93 around 120° apart from one another about the axis 99 of the jig 91. Further illustrated in the example of FIG. 8B are leveling pads 107 shown spaced radially outward from the tube supports 105. The leveling pads 107 are generally elongate members that project downward from lower surfaces of the placement members 93. In an example, the leveling pads 107 spaced apart about 120° from one another and adjacent a placement member 93 having a tube support 105. Receptacle assemblies 109 are illustrated mounted on a lower terminal end of each of the placement members 93 and projecting radially outward the FIG. 9 provides a sectional view of the outer terminal end of an example placement member 93 with attached receptacle assembly 109 shown taken along lines 9-9 of FIG. 8A. In this example, the receptacle assembly 109 includes a generally planar mount 111 that couples to the lower end of the placement member 93 and having an elongate portion substantially aligned with an elongate side of the placement member 93. A receptacle 113 is shown attached to a lower surface of the mount 111 at a location generally radial outward from the terminal end of the placement member 93. The receptacle 113 is a generally annular member that projects downward and circumscribes the medial portion of the mounting member 61*b*. The lower end of the receptacle 113 is shown resting on upper surface 87 of mounting member 61*b*. Upwardly depending shaft 69 of the mounting member 61*b* extends into an axial bore 115 in the mount 111. A bushing 117 is further illustrated having an annular portion inserted in the bore 115 from an upper end that circumscribes the upwardly depending shaft 69 of the mounting member 61*b*. In the example shown, a fastener 119 projects axially through a planar closed end portion of the bushing 117 to attach the bushing 117 to the mounting member 61*b*. A lower surface of the mounting member 61*b* is profiled with a recess 121 whose outer periphery is spaced radially inward from the outer edge of the planar portion of the mounting member 61*b*. A port 123 is shown on upper surface 87 of the mounting member 61*b* that is in communication with the recess 121.

Jig 91 may be lifted by a platform or ship mounted crane (not shown) and positioned so that axis 99 of jig 91 passes through an opening 213 (FIG. 8A) in deck 12. In the illustrated embodiment, axis 99 is coaxial with opening 213. Jig 91 may be lowered so that deck mounting members 61*b* are brought proximate to deck 12, positioning deck mounting members 61*b* in the appropriate location around opening for further mounting of legs 13 to deck 12. Slip rings 63 may then be placed on deck 12 so that jig 91 and deck mounting members 61*b* may be further lowered to land in slip rings 63, thereby positioning slip rings 63 in the appropriately aligned locations on deck 12. Slip rings 63 may then be welded to deck 12 as described above, and the members 61*b* can be welded to their respective slip rings 63 to thereby form the weld 81 (FIG. 7) adjoining the members 61*b* and rings 63. Jig 91 maintains members 61*b* and slip rings in properly aligned horizontal and vertical positions until the welding can be completed. Fasteners 119 are then removed from the bushings 117 and mounting members 61*b* so the bushing 117 can be lifted from the bore 115. Optional bolt holes 125 are illustrated bored transversely through ends of the placement members 93. Bolt holes 125 are threaded so that the bushings 117 can be mounted and stowed on placement members 93 for later use, such as when the jig 91 is redeployed on the same or a different deck (not shown). Jig 91 is removed, leaving the mounting members 61*b* set in the slip rings 63 and welded to the deck. Another advantage of the device and method described herein is that a lower surface of one or more the members 61*b* may be vertically offset from the deck 12, but the relative vertical dimensions of the slip rings 63 and members 61*b* enable their attachment with the weld 81. Thus, the slip rings 63 accommodate angularity of deck 12 or height differences in deck 12 between locations of members 61*b*. Alternatively or additionally, a flowable material, such as an epoxy, can be injected into the port 123 for filling the recess 121. In an example, the flowable material hardens and can withstand compressive forces that may be exerted from an associated member 61*b*. In one embodiment, the flowable material includes a polymer or the like. Deck mounting members 61*b* are mounted to legs 13 as described above for mounting of legs 13 to deck 12 at slip rings 63.

In other embodiments, jig 91 can be employed to position deck mounting members 61*b* directly on deck 12 without slip rings 63. Any gaps existing between the deck mounting members 61*b* and deck 12 may be filled with weld material as deck mounting members 61*b* are welded to deck 12 While attached to jig 91. The jig 91 can then be removed leaving the deck mounting members 61*b* secured to deck 12 in properly aligned positions.

Figure 10:
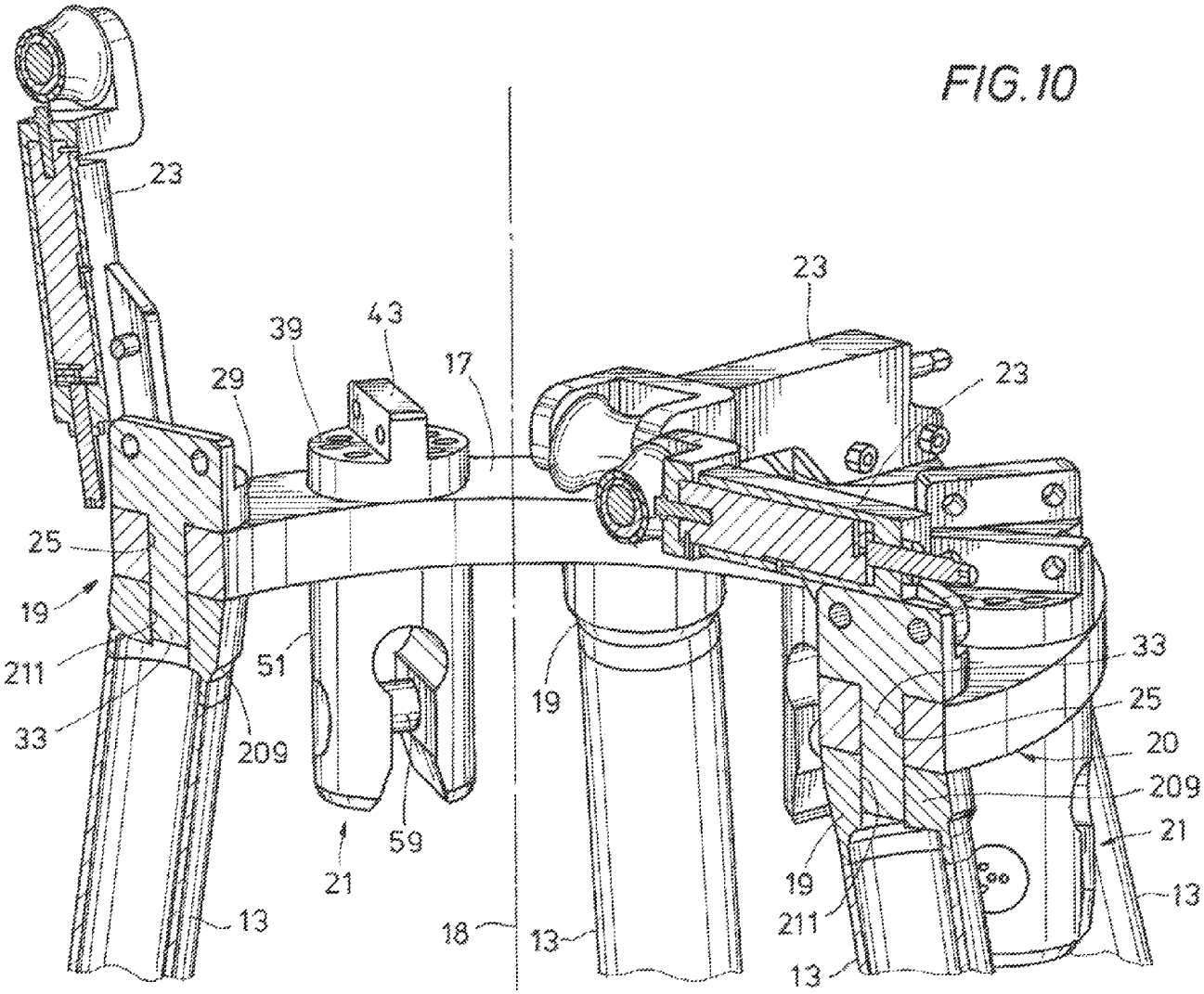
FIG. 10 is a sectional view of the riser tensioner frame assembly of FIG. 1 taken along line 10-10 in accordance with an embodiment.

Referring to FIG. 10, each leg 13 includes a solid upper portion 209 having a bore 211 formed in a medial portion thereof. Bore 211 may have a diameter equivalent to the diameter of each bore 25. In the illustrated embodiment, each leg 13 is circumferentially spaced around support ring 17 and aligned with a corresponding bore 25 of support ring 17. For each leg 13, a separate upper mounting member 19 may be used to secure each leg 13 to support ring 17. For each leg 13, shaft 33 of the associated upper mounting member 19 may be inserted into bore 25 of support ring 17 and into bore 211 of leg 13. Fasteners (not shown) may then be passed through bores 37 (FIG. 3) of the each upper mounting member 19, through corresponding bores surrounding each bore 25 of support ring 17, and threaded into corresponding threaded bores (not shown) formed in upper portion 209 of the associated leg 13, thereby securing leg 13 to support ring 17.

Continuing to refer to FIG. 10, at bores 25 through which legs 13 are not coupled, a cylinder mounting assembly 21 may be mounted. Similar to upper mounting member 19, shaft 47 of cylinder mounting plate 39 may be passed through bore 25 and inserted into the corresponding bore of clevis 51. Fasteners (not shown) may then be passed through cylinder mounting plate bores 41, through corresponding bores (not shown) in support ring 17, and threaded into bores 53 of clevis 51, thereby securing cylinder mounting assemblies 21 to support ring 17 and riser tensioner frame 11. Hydraulic cylinders "C" (FIG. 1) may then be mounted to riser tensioner frame 11 at pin 59 of cylinder mounting assemblies 21.

Riser centralizers 23 may be mounted to both upper mounting assemblies 19 and cylinder mounting assemblies 21 at bores 35, 45 of members 31, 43, respectively, and as is known in the art. Riser centralizers 23 may be any suitable riser centralizer adapted to mount as described herein. In an exemplary embodiment, riser centralizers 23 may be those disclosed in Non-Provisional patent application Ser. No. 13/439,421, entitled "Riser Tensioner System" to Berner, et al., filed Apr. 4, 2012, and incorporated by reference herein.

Accordingly, the disclosed embodiments provide numerous advantages. For example, the disclosed embodiments provide a riser tensioner frame assembly that may be bolted together, allowing for a riser tensioner frame assembly that may be assembled and disassembled in the field more quickly. In addition, the primary structural components of the assembly do not rely on welds, providing a stronger tensioner with fewer potential failure points. In addition, the disclosed embodiments may use both stronger and lighter materials, increasing the strength of the riser tensioner assembly while decreasing the overall weight of the riser tensioner assembly. Still further, the disclosed embodiments provide a riser tensioner frame that may be installed on an un-level deck yet still provide a level tensioner frame assembly for support of a riser.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A tensioner frame assembly for transferring loads from a riser extending from a subsea wellhead assembly through an opening in a deck of a floating platform to the deck of the floating platform, the tensioner frame assembly comprising:

a support ring;

a plurality of cylinder mounting assemblies coupled to the support ring;

a plurality of hydraulic cylinders each having an upper end coupled to one of the cylinder mounting assemblies and a lower end for connection to the riser to exert upward forces on the riser;

a plurality of tensioner legs, each tensioner leg of the plurality of tensioner legs having an upper end coupled to the support ring and a lower end for mounting to the deck, the lower end of each tensioner leg of the plurality of tensioner legs having a bore disposed therein, each of the tensioner legs having a fixed length between the upper and lower ends; and a plurality of lower leg mounting assemblies, each lower leg mounting assembly of the plurality of lower leg mounting assemblies adapted to be mounted directly to the deck and including an upwardly extending shaft passing through the bore disposed in the lower end of a respective tensioner leg that fixes an angle of each respective tensioner leg relative to the deck.

2. The tensioner frame assembly of claim 1, wherein each lower leg mounting assembly of the plurality of lower leg mounting assemblies comprises:

a slip ring defining an inner diameter surface and including a lower surface for mounting directly to the deck; and a deck mounting member including a lower surface and an upper surface from which the upwardly extending shaft extends, the lower surface received in the slip ring such that the lower surface is circumscribed by the inner diameter surface of the slip ring.

3. The tensioner frame assembly of claim 2, wherein a cavity is defined between the an inner diameter surface of slip ring and the lower surface the deck mounting member, and wherein the cavity is filled with a casting compound.

4. The tensioner frame assembly of claim 3, wherein the deck mounting member includes a passage extending therethrough, the passage in fluid communication with the cavity such that the casting compound is flowable through the passage into the cavity.

5. The tensioner frame assembly of claim 2, wherein the deck mounting member is coupled to the slip ring by a circumferential weld filling a gap defined between the deck mounting member and the slip ring.

6. The tensioner frame assembly of claim 2, wherein the deck mounting member includes a connector thereon for coupling the deck mounting member to a jig for positioning the lower leg mounting assemblies on the deck.

7. The tensioner frame assembly of claim 6, wherein each tensioner leg of the plurality of tensioner legs extends radially outward at an oblique angle from the support ring.

8. The tensioner frame assembly of claim 1, wherein the support ring includes a substantially planar lower surface abutting an upper portion of each tensioner leg of the plurality of tensioner legs.

9. The tensioner frame assembly of claim 1, further comprising a plurality of leg mounting assemblies, each having a leg penetrating shaft adapted to pass through a corresponding bore in the support ring and into a bore in the upper end of a respective tensioner leg.

10. The tensioner frame assembly of claim 9, wherein each mounting assembly of the plurality of mounting assemblies includes planar disc from which the leg penetrating shaft depends, the planar disk including a plurality of mounting bores for the passage of fasteners for coupling the planar disk to the support ring.

11. The tensioner frame assembly of claim 10, wherein the planar disk includes an upwardly extending member adapted to receive fasteners for mounting of riser centralizers thereto.

12. A method of securing a tensioner frame assembly to a deck of a floating platform having an opening for a riser, the method comprising the steps of:

providing a jig including a plurality of radially spaced receptacle assemblies;

securing a respective deck mounting member to each receptacle assembly of the plurality of receptacle assemblies;

aligning the jig with the opening such that each receptacle assembly of the plurality of radially spaced receptacle assemblies is radially spaced about the opening and each deck mounting member is vertically approximated with the deck;

positioning a plurality of slip rings on the deck such that each respective slip ring of the plurality of slip rings is located beneath a respective deck mounting member;

lowering the jig to land each deck mounting member into the respective slip ring to thereby locate the respective slip rings in aligned positions on the deck;

securing the respective slip rings to the deck in the aligned positions;

securing the respective deck mounting members to the respective slip rings;

decoupling the respective deck mounting members from each of the respective receptacle assemblies; and fastening a respective tensioner leg of the tensioner frame assembly to each of the deck mounting members.

13. The method of claim 12, further comprising the step of injecting a flowable material into a cavity in each slip ring of the plurality of slip rings defined between the deck and a lower surface of the respective deck mounting members.

14. The method of claim 12, wherein the steps of securing the respective slip rings to the deck and securing the respective deck mounting members to the respective slip rings comprise forming a circumferential weld about the respective slip rings.

15. The method of claim 12, further comprising the step of coupling an upper end of each of the respective tensioner legs to a support ring of the tensioner frame assembly by passing fasteners through bores defined through the support ring.

16. A riser tensioner for maintaining a tensile force on a riser extending from a subsea wellhead assembly through an opening in a deck of a floating platform, the riser tensioner comprising:

a plurality of tensioner legs, each having a lower end for mounting to the deck;

an annular support ring positioned proximate upper ends of the tensioner legs;

a plurality of leg mounting assemblies, each having a shaft adapted to pass through a corresponding bore in the support ring and into a bore in an upper end of the tensioner legs;

a plurality of lower leg mounting assemblies, adapted to be mounted to the platform deck and having an upwardly extending shaft adapted to pass through a bore in a lower end of the respective tensioner leg; and a plurality of cylinder mounting assemblies adapted to mount to the support ring at one of the plurality of bores formed therein.

17. The riser tensioner of claim 16, further comprising a plurality hydraulic cylinders each having a first end adapted to be coupled to a respective cylinder mounting assembly of the plurality of cylinder mounting assemblies, and having a second end adapted to be operatively coupled to the riser to apply a tensile force thereto.

18. The riser tensioner of claim 16, wherein each lower leg mounting assembly of the plurality of lower leg mounting assemblies comprises:

a slip ring defining an inner diameter surface and including a lower surface for mounting directly to the deck;

a deck mounting member including a lower surface and an upper surface from which the upwardly extending shaft extends, the lower surface received in the slip ring such that the lower surface is circumscribed by the inner diameter surface of the slip ring; and a casting compound disposed within a cavity defined between the an inner diameter surface of slip ring and the lower surface the deck mounting member.

* * * * *